US006116868A

United States Patent [19]

Lu

[11] Patent Number: 6,116,868

[45] Date of Patent: Sep. 12, 2000

[54] MULTI-FACETED VALVE HEAD FOR HYDRAULIC PUMP

[76] Inventor: Chung-Tai Lu, 58, Ma Yuan West St., Taichung, Taiwan

[21] Appl. No.: 09/260,356

[22] Filed: Mar. 1, 1999

[51] Int. Cl.[7] ..... F04B 23/00; F04B 49/00

[52] U.S. Cl. ..... 417/440; 417/305; 417/307

[58] Field of Search ..... 417/440, 307, 417/305; 222/385, 318, 380

[56] References Cited

U.S. PATENT DOCUMENTS

| | | | |
|---|---|---|---|
| 2,531,794 | 11/1950 | Walmsley | 417/305 |
| 2,781,728 | 2/1957 | Fischer et al. | 417/305 |
| 3,819,303 | 6/1974 | Pfleger | 417/305 X |
| 3,824,043 | 7/1974 | Nordel | 417/440 |
| 3,857,404 | 12/1974 | Johnson | 137/102 |
| 3,974,742 | 8/1976 | Johnson | 91/420 |
| 5,381,932 | 1/1995 | Humphrey et al. | 222/385 |
| 5,404,901 | 4/1995 | Pickrell et al. | 137/381 |
| 5,673,824 | 10/1997 | Evans | 222/321.1 |

*Primary Examiner*—Charles G. Freay
*Assistant Examiner*—Michael K. Gray

[57] ABSTRACT

A hydraulic oil tank connects to a valve head (10) which is provided with an oil return switch (2) accomodated in an oil return hole (14). An adjusting valve (3) is accomodated in an adjusting hole (13) of the valve head. An oil chamber hole (15) accomodates a check valve (4). A pivot rod hole (11) accomodates a pivot rod (5) and a pump hole (12) accomodates a pump (6). The check valve is in fluid communication with a conduit (8) which, for example, connects to a tube of a hydraulic jack. The valve head allows hydraulic fluid to be imparted to a jack at a controlled, desired pressure and allows advantageous return of fluid to the oil tank.

1 Claim, 7 Drawing Sheets

MULTI-FACETED VALVE HEAD FOR HYDRAULIC PUMP

BACKGROUND OF THE INVENTION (a) Field of the Invention

The present invention relates to a multi-faceted valve head for hydraulic pump.

(b) Description of the Prior Art

Jacks are indispensable and convenient means of lifting loads. As scissor type jacks in particular facilitate operation in narrow or tight spaces, they have wide application. A jack in general utilizes an internal hydraulic thrust in conjunction with a lifting structure. In other words, all the lifting forces of the jack are provided by an oil hydraulic structure. It can therefore be seen that the construction of the multi-faceted valve head of an oil hydraulic pump is of utmost importance. As the multi-faceted valve head of conventional oil hydraulic pumps are comprised of a plurality of symmetrical and inter-communicated check valves, pressure adjusting valves, and oil passages, they have the following drawbacks:

1. As the multi-faceted valve head portion of the conventional oil hydraulic pump is comprised of a plurality of ducts that are inter-communicated or staggered, the ducts are often angular, which make the processing process very difficult. Besides, there are the problems of oil leakage or insufficient force due to holes or blocked communication.
2. As the check valve s and pressure adjusting of the multi-faceted valve head of the conventional oil hydraulic pump are symmetrically disposed, the output of pressure may be uneven.
3. Due to the above-mentioned uneven output of pressure in conventional multi-faceted valve head construction, the adjustment and control of pressure is also deficient.

SUMMARY OF THE INVENTION

A primary object of the present invention is to provide a multi-faceted valve head for hydraulic pump in which an oil chamber inside the multi-faceted valve head is communicated respectively with an oil return switch, a tube at a front end of the oil chamber, and an adjusting valve and is connected to an oil tank. The pump multi-faceted valve head of the present invention has the following advantages:

1. In the present invention, the oil chamber is communicated respectively with the oil return switch, the tube at the front end of the oil chamber, and the adjusting valve, and is connected to the conduit, the hydraulic oil in the oil chamber can be controlled by a pump, and it is only necessary to provide a check valve. Therefore, the processing procedures are relatively simple and easy to control, thereby reducing faulty product rates.
2. The hydraulic oil pressure is directly output to the oil chamber by the pump, and the pressure can be controlled by means of the adjusting valve. Hence, the pressure is stable and adjustable according to the weight of the loads to be lifted.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
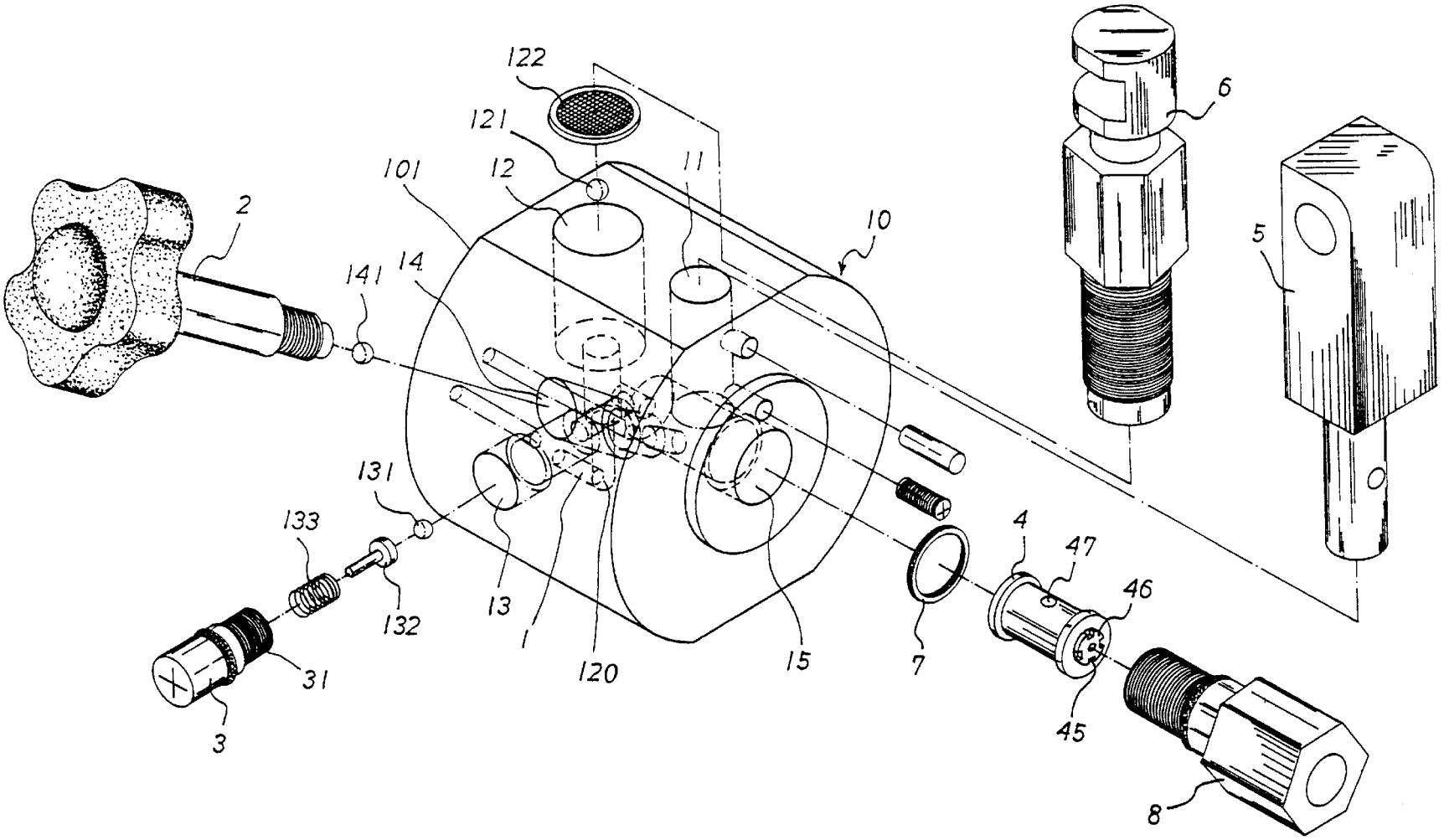
FIG. 1 is an exploded perspective view of the present invention.
Figure 2:
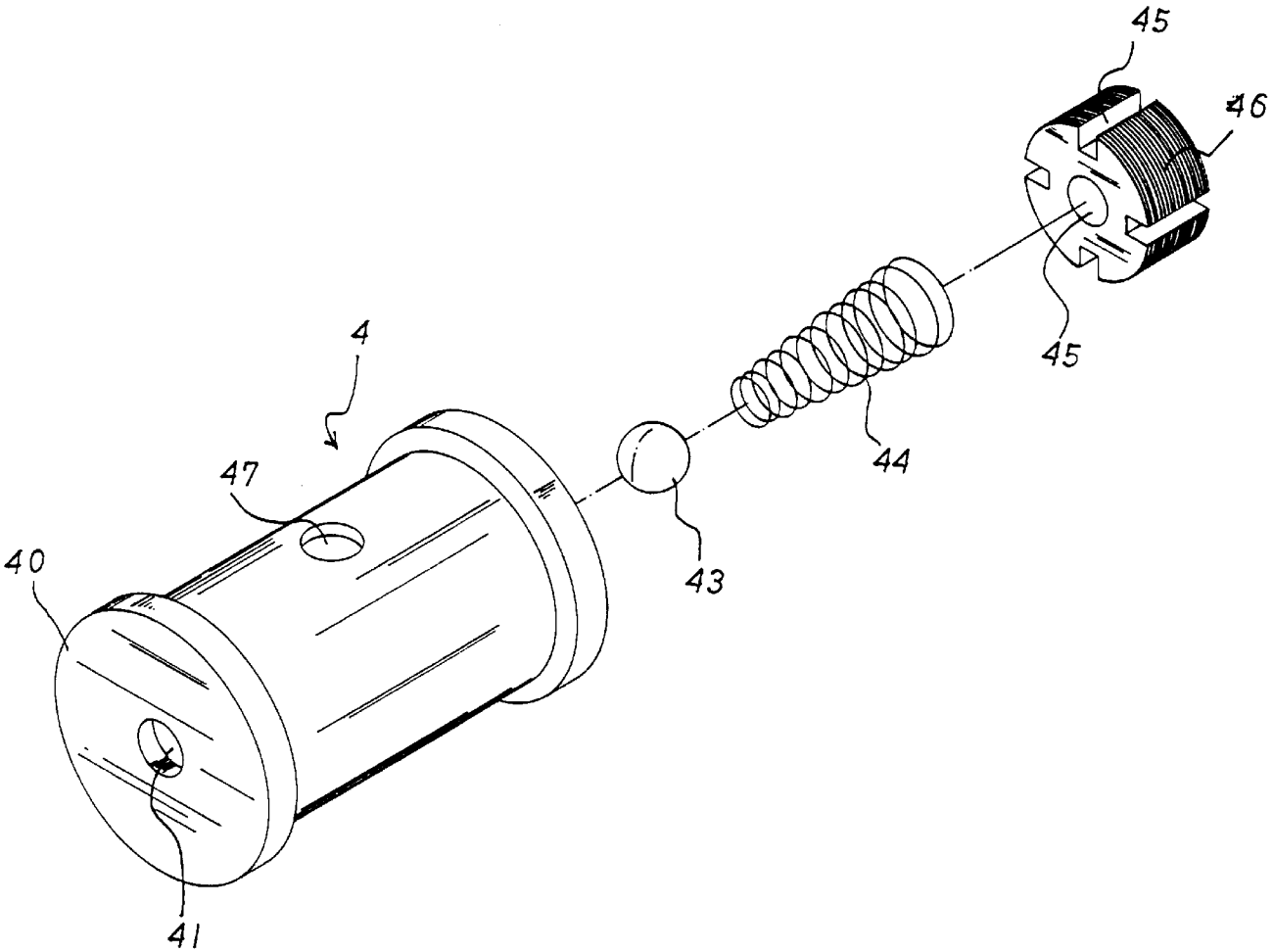
FIG. 2 is a perspective view of a check valve of the present invention.

Referring to FIGS. 1 and 2, a 1, 2 and 4, a multi-faceted valve head 10 for hydraulic pump has a front end 101 fixedly connected to an oil tank (not shown in the figures) via a conduit 1 and, via an oil return switch 2, an adjusting valve 3, and a check valve 4 in order to supply a hydraulic oil to a jack oil tube 9 (see FIG. 1).

The multi-faceted valve head 10 is provided with a pivot rod hole 11 and a pump hole 12 arranged in an opposed relationship, and an adjusting hole 13, an oil return hole 14, and an oil chamber hole 15. The pump hole 12 is a three-step reducing structure for receiving a ball 121 and a filter mesh 122, respectively. The oil chamber hole 15 is provided at a rear end 1520 of an oil chamber 152 and is communicated with the second-step hole 120 of the pump hole 12 via a connecting hole 151. The adjusting hole 13 is connected with the connecting hole 151 and that utilizes the second-step hole thereof to be communicated with the conduit 1. The adjusting hole 13 receives a round ball 131, an urging pin 132, and a spring 133, respectively. The oil return hole 14 has a rear end 140 connected to the oil chamber 152, and that has a second-step hole for receiving a steel ball 141 and is directly communicated with the conduit 1.

The oil return switch 2 is a screw that is lockably disposed in the oil return oil 14 and that is adapted to urge against the steel ball 141.

The adjusting valve 3 is a screw that is lockably disposed in the adjusting hole 13 and is adapted to urge against the spring 133, the urging pin 132, and the round ball 131.

The check valve 4 is an I-shaped through tube that includes a front end 40 formed with a through hole 41 and a receiving chamber 42 connected to the end 40. The receiving chamber 42 receives an urging ball 43 and a conical spring 44. The conical spring 44 is secured by means of a screw post 46 having a plurality of flutes 45. In addition, the receiving chamber 42 is formed with a plurality of axial holes 47, as shown in FIG. 2.

Figure 3:
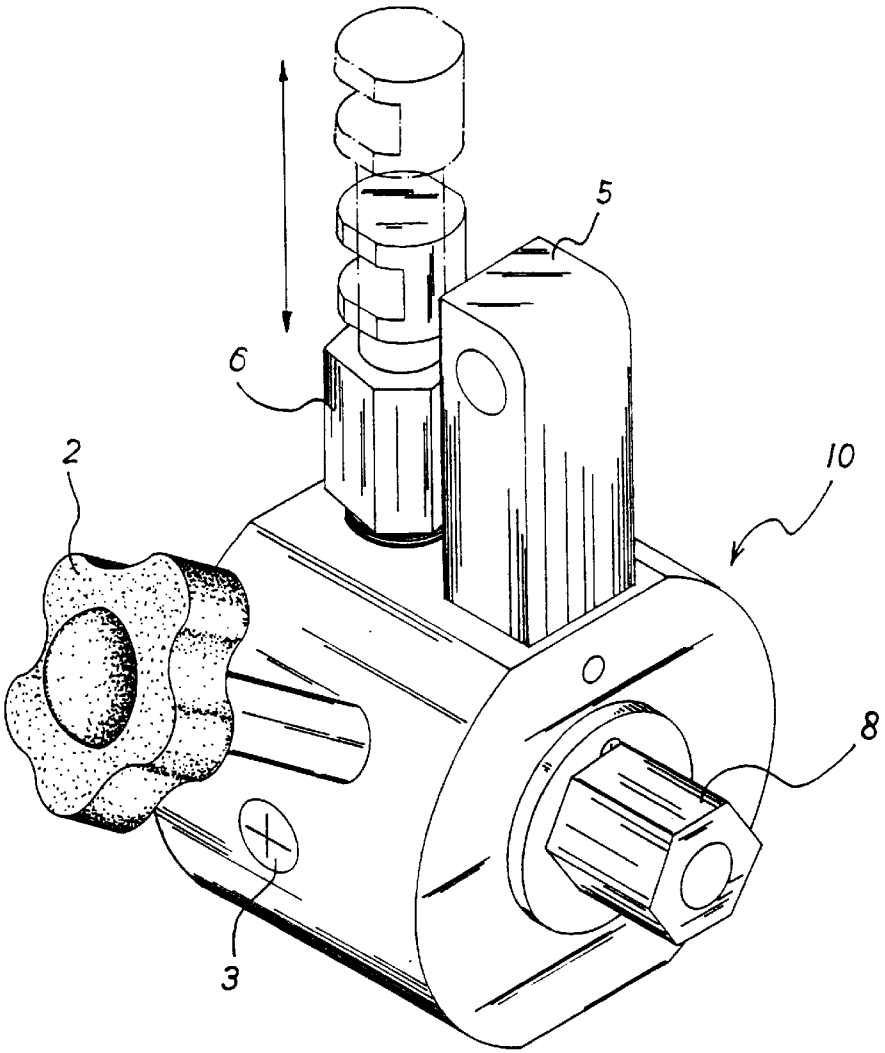
FIG. 3 is an assembled perspective view of the present invention.

During assembly, a pivot rod 5 is disposed in the pivot rod holes 11, and the pump 6, the oil return switch 2, and the adjusting valve 3 having front end threaded sections 31 are screwably secured on the first-step holes of the pump hole 12, the oil return hole 14, and the adjusting hole 13, respectively. The check valve 4 is then placed in the oil chamber 152 along with an oil seal ring 7. A coupling 8 is screwably connected to the oil chamber hole 15 such that the coupling 8 is communicated therewith via the flutes 45 of the screw post 46, thus accomplishing the multi-faceted valve head 10 of the present invention as shown in FIG. 3.

Figure 4:
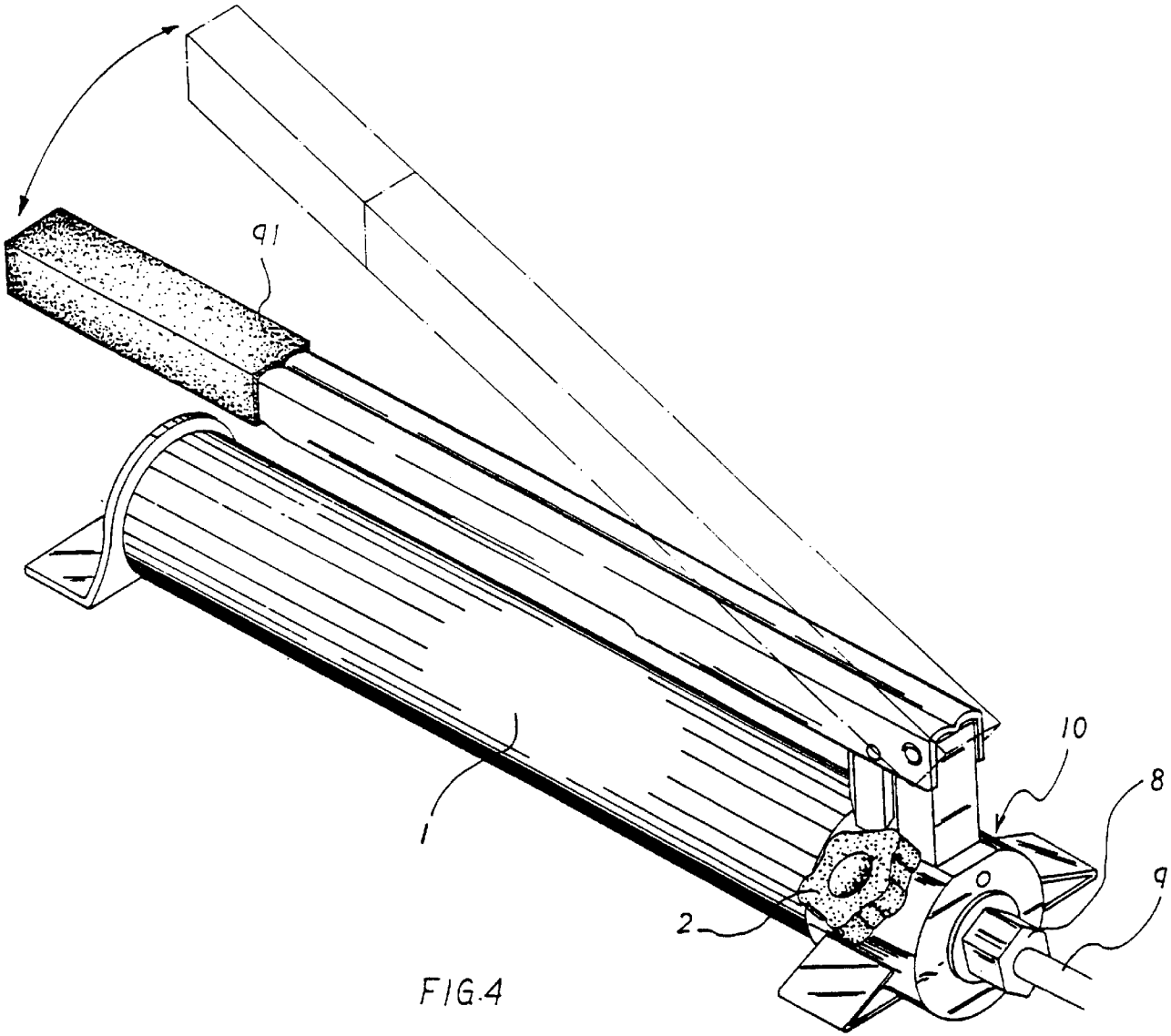
FIG. 4 is a schematic view illustrating operation of a pump of the present invention.
Figure 5A:
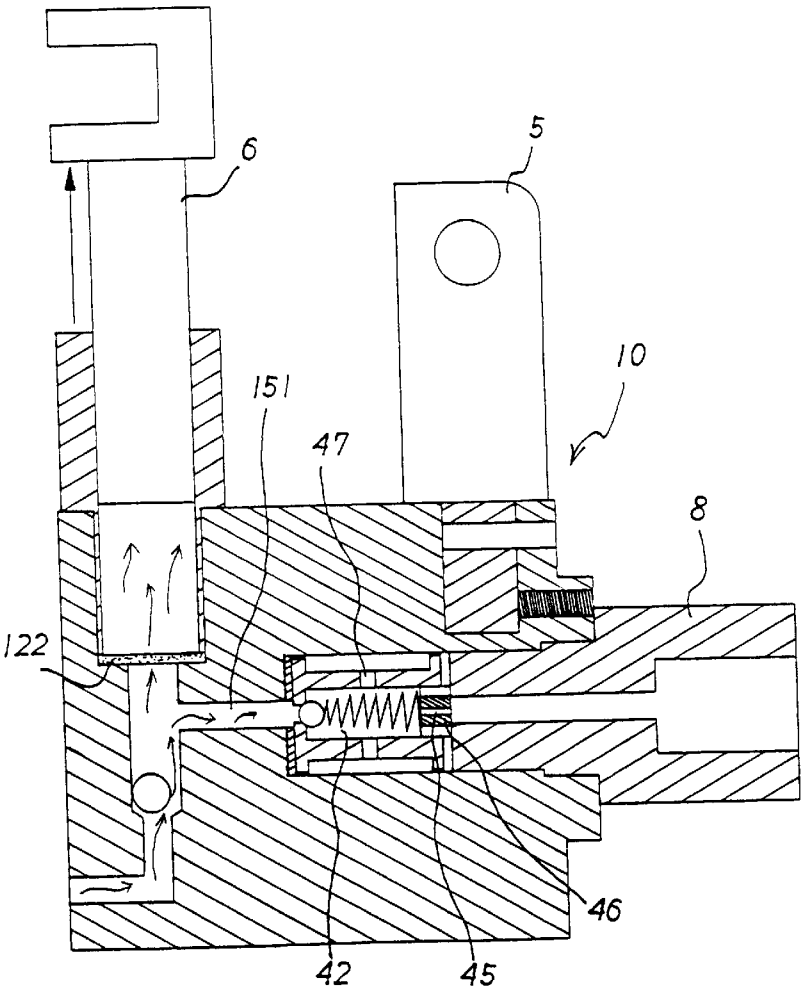
FIGS. 5 and 5A are sectional views illustrating operation of a multi-faceted valve head of the present invention.
Figure 5:
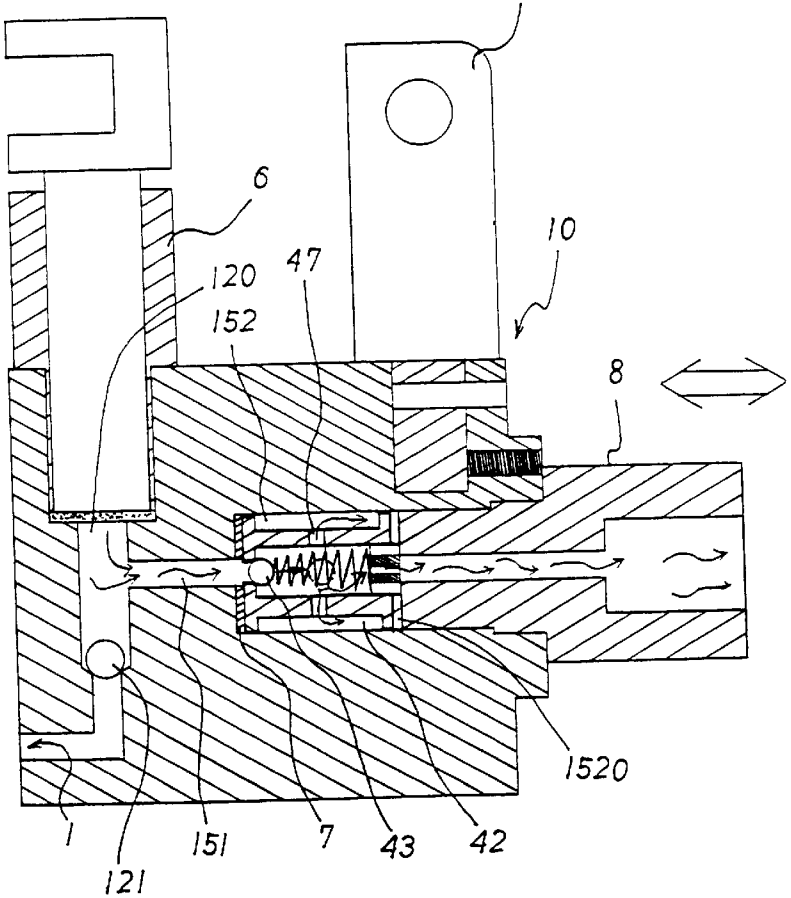
Figure 6:
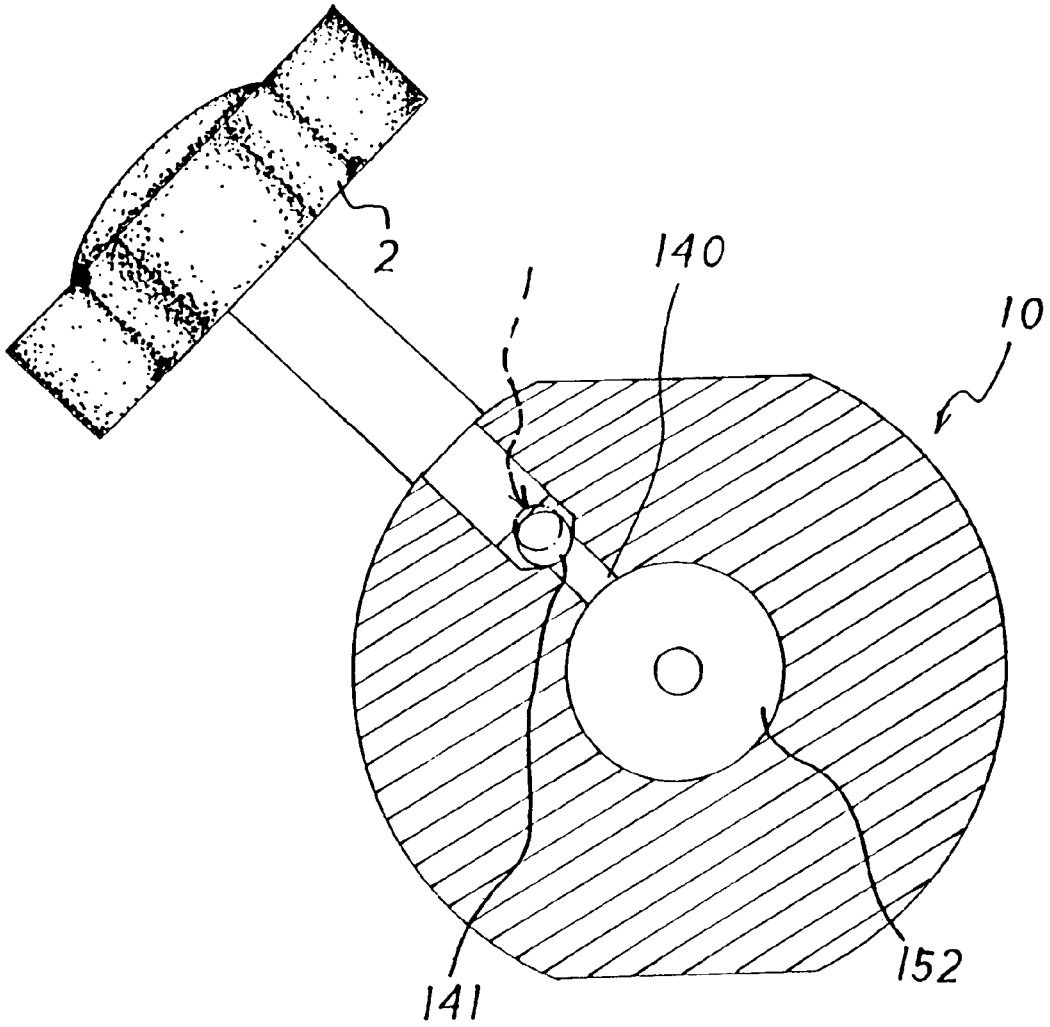
FIG. 6 is a sectional of an oil return hole of the present invention.
Figure 7:
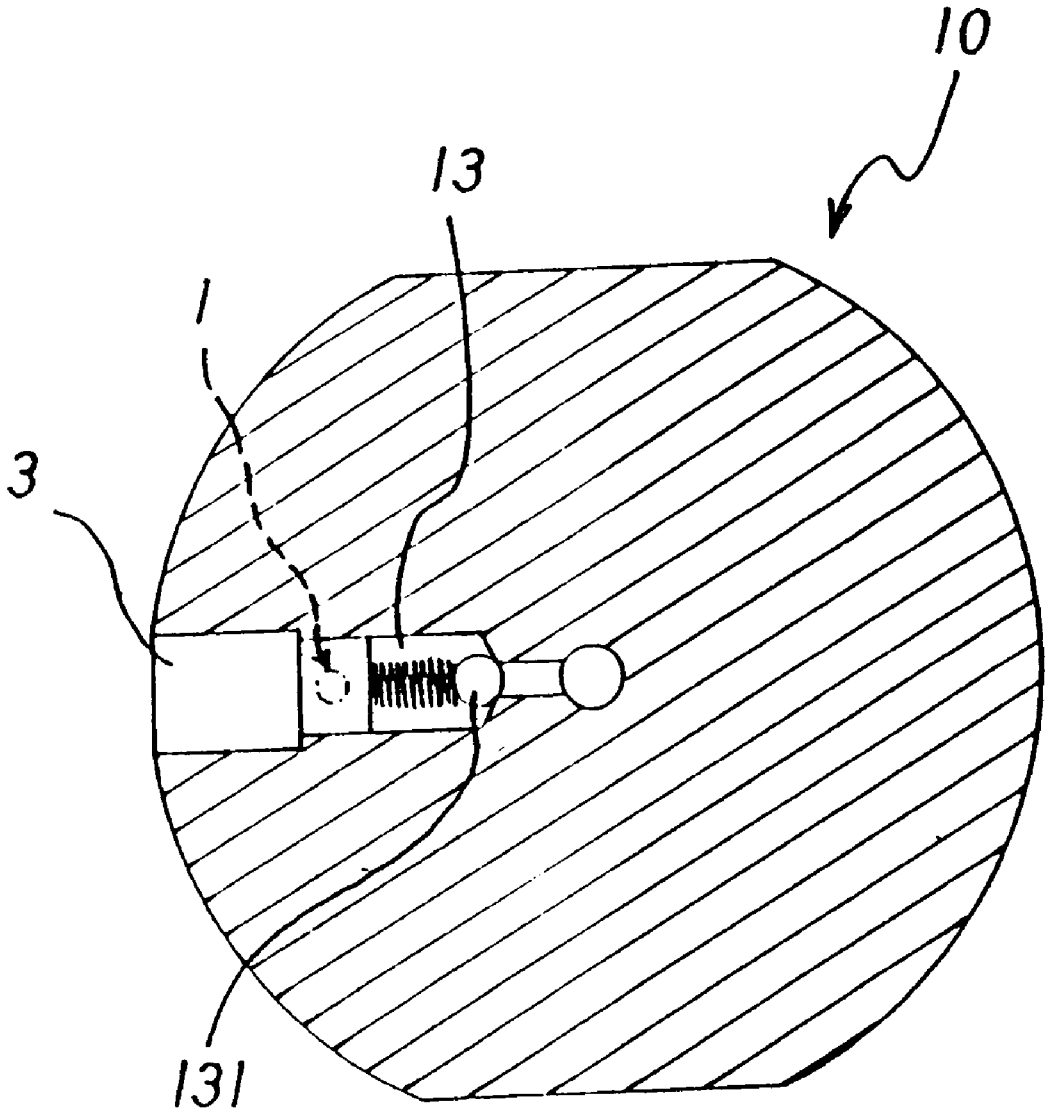
FIG. 7 is a sectional view of an adjusting hole of the present invention.

In practice, the end of the coupling 8 of the multi-faceted valve head 10 is connected to a jack (see FIG. 4) via an oil tube 9. The other end is securely connected with the conduit 1. A handle 91 is pivotally provided in the pivot rod 5 and is inserted into the pump 6. Hence, by moving the handle 91 relative to the pivot rod 5, the pump 6 is caused to perform pumping actions. When the pump 6 is drawing in hydraulic oil, as shown in FIGS. 5 and 5A, the hydraulic oil will push the ball 121 out of the second-step hole 120 and will flow into the pump 6. When the pump 6 pushes out the hydraulic oil inside, the ball 121 will again block communication with the conduit 1 so that the hydraulic oil inside the pump 6 flows past the connecting hole 151 to push the urging ball 43 of the check valve 4, causing the hydraulic oil to fill the oil chamber 152 and to flow past the flutes 45, the coupling 8, and the oil tube 9 into the interior of the jack to provide a lifting force. It can therefore be seen the round ball 131 of the adjusting valve 3 can, due to its urging action, prevent the high-pressure hydraulic oil in the oil chamber 152 from returning to the oil tank via the adjusting hole, as shown in FIGS. 6 and 7. Therefore, when the round ball 131, relative to the turning and control of the adjusting valve 13, opens or closes a clearance, it can cause a part of the high-pressure hydraulic oil to return to the oil tank (not shown in the figures) directly, releasing the pressure of the hydraulic oil conveyed to the jack from the oil chamber 152. Besides, since the connecting hole 151 and the jack are connected via the check valve 4, the adjusting valve 3 will not cause the pressure of the hydraulic oil that has been conveyed into the jack to leak. In other words, the adjusting valve can be utilized to achieve control of the magnitude of the pressure of the output hydraulic oil. Furthermore, the oil return switch 2 and the oil chamber 152 are directly closed by the steel ball 141 so that when the oil return switch 2 is loosened, the hydraulic oil inside the jack can flow reversely from the receiving chamber 42 and the axial holes 47 inside the check valve 4 into the oil (not shown in the figures), thus facilitating relief of pressure.

Although the present invention has been illustrated and described with reference to the preferred embodiment thereof, it should be understood that it is in no way limited to the details of such embodiment but is capable of numerous modifications within the scope of the appended claims.

What is claimed is:

1. A multi-faceted valve head for hydraulic pump having:

a front end connected to an oil tank via a conduit and, via control of an oil return switch, an adjusting valve , and a check valve in order to supply a hydraulic oil to an oil tube of the jack, the multi-faceted valve head further having a pivot rod hole and a pump hole arranged in an opposed relationship, and an adjusting hole, an oil return hole, and an oil chamber hole, said pump hole being a three-step reducing structure adapted to receive a ball and a filter mesh, respectively, said oil chamber hole provided at a rear end of an oil chamber and that is communicated with a second-step hole of said pump hole via a connecting hole, said adjusting hole connected with said connecting hole and that utilizes a second-step hole thereof to be communicated with said conduit, said adjusting hole being adapted to receive a round ball, an urging pin, and a spring, respectively, said oil return hole having a rear end connected to said oil chamber and that has a second-step hole adapted to receive a steel ball and that is directly communicated with said conduit, said oil return switch being a screw lockably disposed in said oil return hole for urging said steel ball, said adjusting valve being a screw lockably disposed in said adjusting hole for urging said spring, said urging pin, and said round ball, said check valve being an I-shaped through tube that includes a front end formed with a through hole and a receiving chamber connected to said front end, said receiving chamber receiving an urging ball and a conical spring, said conical spring being secured by means of a screw post having a plurality of flutes, said receiving chamber having a plurality of axial holes, a pivot rod being secured in said pivot rod hole, said pump, said oil return switch, and said adjusting valve having front end threaded sections that are screwably secured in said pump hole, said oil return hole, and said adjusting hole, respectively, a coupling being screwably secured in said oil chamber hole causing said flutes of said screw post to be communicated with said jack via said coupling, a handle being pivotally provided in said pivot rod secured in said pivot rod hole to be insertably connected to said pump to thereby perform sucking actions and pushing actions, the sucking force causing the hydraulic oil in said oil tank to push said ball out of the second-step hole and to flow into said pump, said adjusting valve urging said round ball so as to control the state of closure of said round ball to cause the hydraulic oil that is not output to said check valve to return to said oil tank for pressure adjustment purposes, said steel ball being provided to isolate said oil chamber and said oil tank such that when said oil return switch relatively releases said steel ball, and the hydraulic oil pressure inside the jack is quickly relieved.

* * * * *